United States Patent [19]

Pilat

[11] 4,304,328

[45] Dec. 8, 1981

[54] RECEPTACLE STORAGE PACKAGE HAVING OBLIQUE SURFACES

[76] Inventor: George R. Pilat, 3632 Greenwich Rd., Norton, Ohio 44203

[21] Appl. No.: 125,140

[22] Filed: Feb. 27, 1980

[51] Int. Cl.[3] ..... B65D 85/44

[52] U.S. Cl. ..... 206/45.19; 206/45.25; 206/426; 206/459

[58] Field of Search ..... 206/426, 45.14, 45.19, 206/45.25, 459

[56] References Cited

U.S. PATENT DOCUMENTS 4,130,202 12/1978 Champlin et al. ..... 206/426

4,204,598 5/1980 Adams ..... 206/426

*Primary Examiner*—Joseph Man-Fu Moy

*Attorney, Agent, or Firm*—Oldham, Oldham, Hudak & Weber Co.

[57] ABSTRACT

A receptacle storage package is disclosed, having oblique base surfaces converging in such a manner as to tilt the receptacles towards one another. The receptacles would contact each other, in storage, but for the placement of a receptacle restraining piece position between the upper surfaces of the receptacles. Should the restraining piece be removed, the receptacles will contact under gravitational force.

10 Claims, 4 Drawing Figures

RECEPTACLE STORAGE PACKAGE HAVING OBLIQUE SURFACES

BACKGROUND OF THE INVENTION

Heretofore, the storage and packaging of receptacles available for fluid or containing fluid have traditionally been placed in parallel-spaced relationships, preventing their contact and engagement. Container packaging such as cartons for softdrink bottles typify this packaging concept, wherein vertical restraining material contacts horizontal base surfaces to provide a compartment which may house the receptacle or bottle without intended contact either during packaging and storage or upon removal of the packaging. This salutary purpose of storage of breakable receptacles is not always desired when the receptacles are intended to collide producing a pleasing sound commonly associated with toasts and other joyous occasions.

Consequently, the vertical and horizontal surfaces for the traditional bottle compartments are not adequate to isolate the bottles in a position where gravitational impetus may contact adjacent bottles when the appropriate packaging is removed.

OBJECTS OF THE INVENTION

Consequently, it is an object of the invention to provide a packaging product having oblique base surfaces slanting towards each other, upon which receptacles resounding upon contact may be positioned.

It is another object of the invention to provide a receptacle storage package, as above, wherein the oblique base surfaces have positioning means to position to resounding receptacle on the oblique base surfaces.

It is yet another object of the invention to provide a receptacle storage package, as above, wherein receptacle restraining means as interposed between the upper surfaces of adjacent resounding receptacles prevent contact of the receptacles during storage.

Still another object of the invention is to provide a method for restraining a plurality of receptacles slanted to contact one another, wherein the positioning of each receptacle is secured on an oblique base surface of a package.

Another object of the invention is to provide a method for restraining a number of resounding receptacles, as above, wherein an interspacing material restrains at least two of the receptacles from contacting each other when adjacent and subject to gravitational forces.

These and other objects of the invention, which will become more apparent as the detailed description of the preferred embodiment proceeds, are achieved by a package restraining a plurality of resounding receptacles, comprising:

a plurality of sidewall perimeter surfaces joined contiguously defining a packing recess;

a plurality of base surfaces residing in said packing recess and communicating with at least one sidewall perimeter surface;

each said base surface oblique to each said communicated sidewall perimeter surface and each said base surface further oblique to at least one oblique surfaces intersection;

means extending from each said oblique base surface for positioning one resounding receptacle on each said oblique base surface; and means interspaced between at least two resounding receptacles for restraining contact of adjacent receptacles under gravitational impetus.

These objects are further achieved by a method of restraining a plurality of resounding receptacles inclined by gravitational force to contact one another, comprising:

(a) positioning each resounding receptacle on one of a plurality of oblique base surfaces, each said base surface oblique to at least one adjacent said oblique base surface and converging on at least one oblique surface's intersection; and (b) restraining with interspacing material at least two resounding receptacles from contact of adjacent receptacles under gravitational impetus.

DESCRIPTION OF THE DRAWINGS

For appreciation of the scope of the invention, reference is had to the drawings, wherein.

DETAILED DESCRIPTION OF THE PREFERRED EMBODIMENTS

Figure 1:
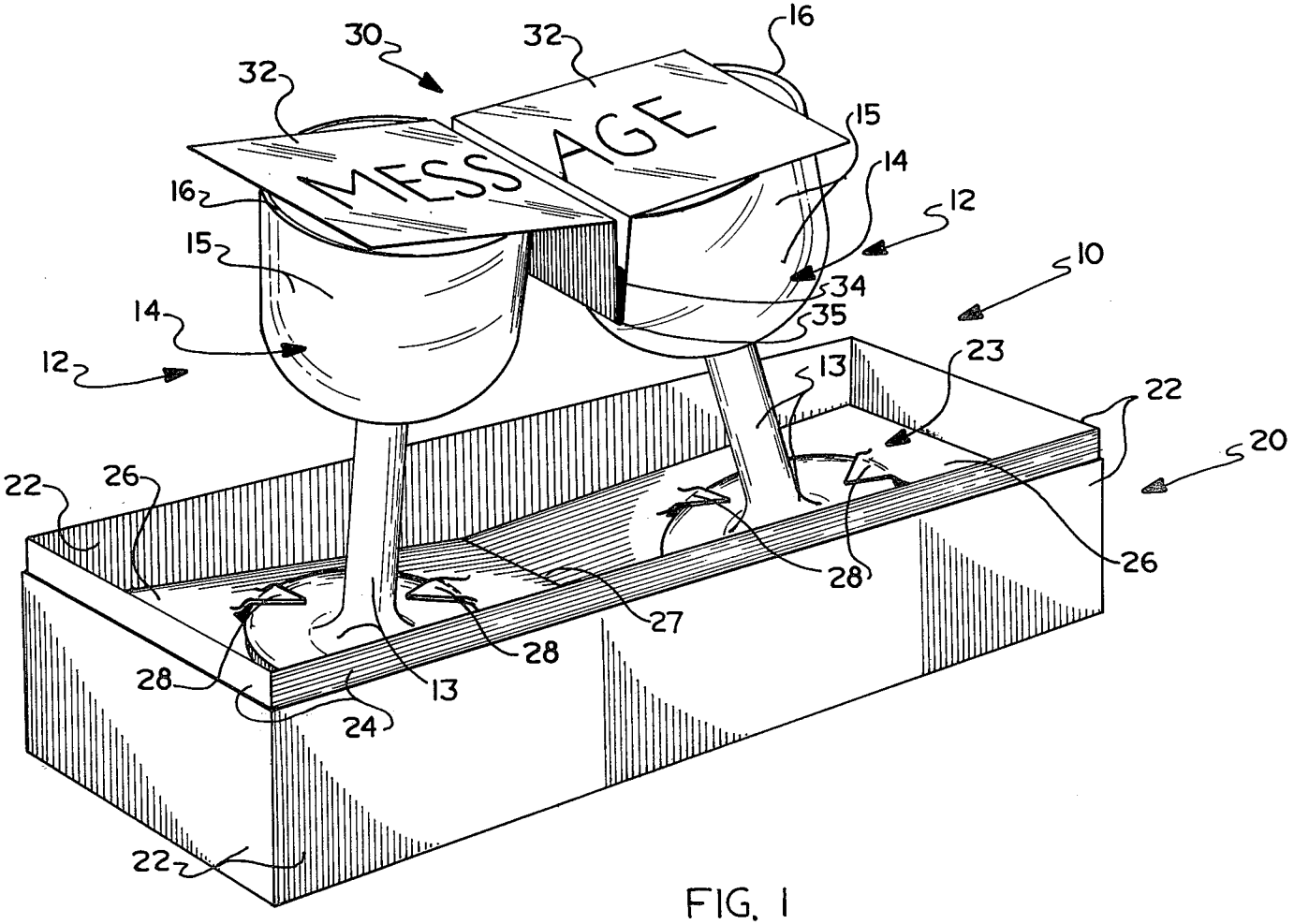
FIG. 1 is a perspective view of the receptacle storage package with the upper package member removed.
Figure 3:
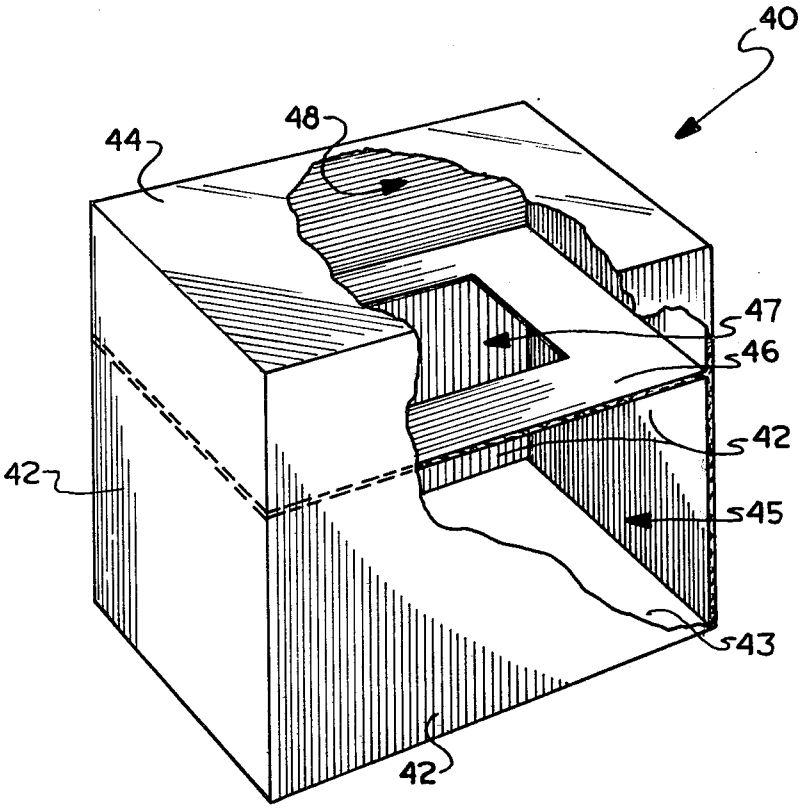
FIG. 3 is a cutaway perspective view of the upper package.

For an understanding of the scope of the concept of this invention, reference is had to the combination of FIG. 1 and FIG. 3. FIG. 1 demonstrates the assembly of receptacle storage package, generally referred to as 10, and lower package member, generally referred to as 20. In FIG. 3, upper package member, generally referred to as 40, is illustrated. For complete and protective storage, upper package member 40 is placed over the receptacles extending from lower package member 20, and upper package member 40 engages recessed shoulder 24 on lower package member 20.

Referring again to FIG. 1, it is seen that the receptacle storage package 10 is designed for positioning and restraining receptacles 12 which may resound when contacting each other under gravitational forces. The receptacles 12 may be champagne glasses, wine glasses, brandy glasses, decorative vessels, or any other vessels known to those skilled in the art which are commonly used for contacting each other in a celebration. Typical celebrations include contacting each of the receptacles with each other in a toast or other pledge or recognition of achievement or award. The receptacles 12 may be made of materials known to those skilled in the art providing a pleasing sound when contacting one another, such as glass, crystal, specialty metals, and other materials known to those skilled in the art. Each of the receptacles has a container portion 14 for containing liquids to be used in the celebration or toast and a base portion 13 either comprising a stem and flat base or a sloping base from the lower extremities of the container portion 14. Further, each container portion 14 is composed of an outer container surface 15, either circular or having a polyhedral shape, and having a lip edge 16 for human consumption.

Each resounding receptacle 12 is positioned within the lower package member 20. Member 20 is composed of a plurality of outer sidewall perimeter surfaces 22, and preferably, as shown in FIG. 1, having four surfaces joined contiguously. However, the scope of the invention is not limited to the preferred four surfaces. Rather, any number of surfaces 22 may create a polyhedral lower package member 20.

The contact of outer sidewall perimeter surfaces 22 contiguously forms a packing recess, generally defined as 23. Departing from the scope of the materials known to those skilled in the art, where the packing recess 23 generally forms an orthogonal recess, a plurality of base surfaces 26 are placed within recess 23. Each of the base surfaces 26 is oblique to at least one of the outer sidewall perimeter surfaces 22. Further, each surface 26 is oblique to at least one adjacent oblique surface 26, which when assembled in a continguous relationship defines an oblique surface intersection 27. It is within the scope of the present invention to provide a plurality of oblique base surfaces 26 which contact one another at a plurality of oblique surface intersections 27. However, the preferred embodiment of the present invention is depicted in FIG. 1, showing two oblique base surfaces 26 intersecting at one oblique surface intersection 27.

By this construction, a resounding receptacle 21 is positioned on each oblique base surface 26. By their obliquity, the base surfaces 26 position the receptacles 12 to engage each other as directed by gravitational forces. On such slanted surfaces 26, receptacles 12 must be positioned, using receptacle positioning means 28. These positioning means 28 comprise a plurality of members extending from the surface of each oblique base surface 26 to engage a particular type of base portion 13 for the receptacle 12 being employed within package 10. The receptacle means 28 securely position the receptacle 12 on each surface 26 in a position to contact one another in the container portions 14 of each receptacle 12.

The storage of receptacles 12 with container portions 14 contacting each other lacks practicality. Further, to delay contact of the receptacles 12 until such time as celebration and toasting require it, the resounding receptacles 12 are interspaced by receptacle restraining means 30 placed between container portions 14 of adjacent receptacles 12. Receptacle restraining means 30 is composed of a number of upper exposed surfaces 32 extending over lip edges 16 of each receptacle and a number of spacing surfaces 34 extending between receptacles 12 in contact with outer container surfaces 15 of container portion 14. Because the number of receptacles may vary according to the requirements of each package 10, the shape of surfaces 32 and 34 must be adjusted accordingly. Further, spacing surfaces 34 must intersect at at least one acute angle 35. While it is preferred that the receptacle restraining means comprise one piece of material, it is also possible to provide a segment of restraining means 32 having an upper exposed surface 32 and a spacing surface 34 for each resounding receptacle 12. In such case, acute angle 35 is not a fold, but rather a contacting intersection.

Figure 2:
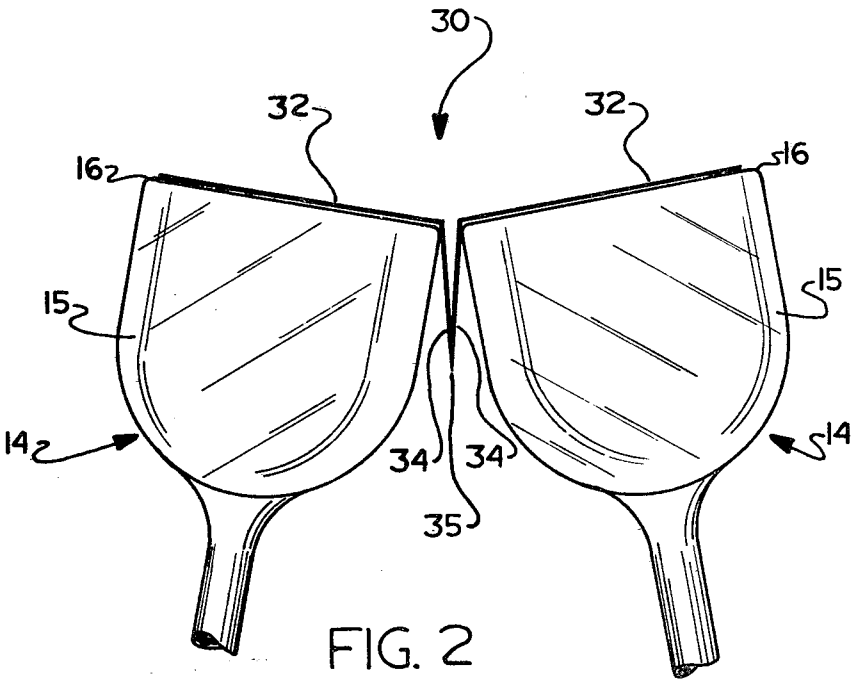
FIG. 2 is a side plan view of the restraint between adjacent resounding receptacles.

As seen in FIG. 2, the container portions 14 of each receptacle 12 are restrained by receptacle restraining means 30. The angle of inclination of each container portion 14 is dictated by the slope of each oblique base surface 26. This angle of inclination may vary from about zero degrees to about 40 degrees, and preferrably from about 10 degrees to about 20 degrees. Again as seen in FIG. 2, adjacent spacing surfaces 34 are preferred to be folded at acute angle 35. The material restraining means 30 may then provide a tension at acute angle 35 to restrain adjacent container portions 14 from contacting. Further, the tension available at acute angle 35 determines the extent to which a sound is created when receptacles 12 contact. It is also noted from FIG. 2 that the angle of inclination of upper surfaces 32 is substantially the same as that angle of inclination for the corresponding oblique base surface 26 beneath receptacle 12.

Referring again to FIG. 1, in the examination of the upper exposed surfaces 32 of the receptacle restraining means 30 indicates that a message may be composed and printed or inscribed thereon to greet and surprise the person removing the upper package member 40 from lower package member 20. This message may be so composed as to be suitable for the particular occasion being celebrated, or awarded.

Figure 4:
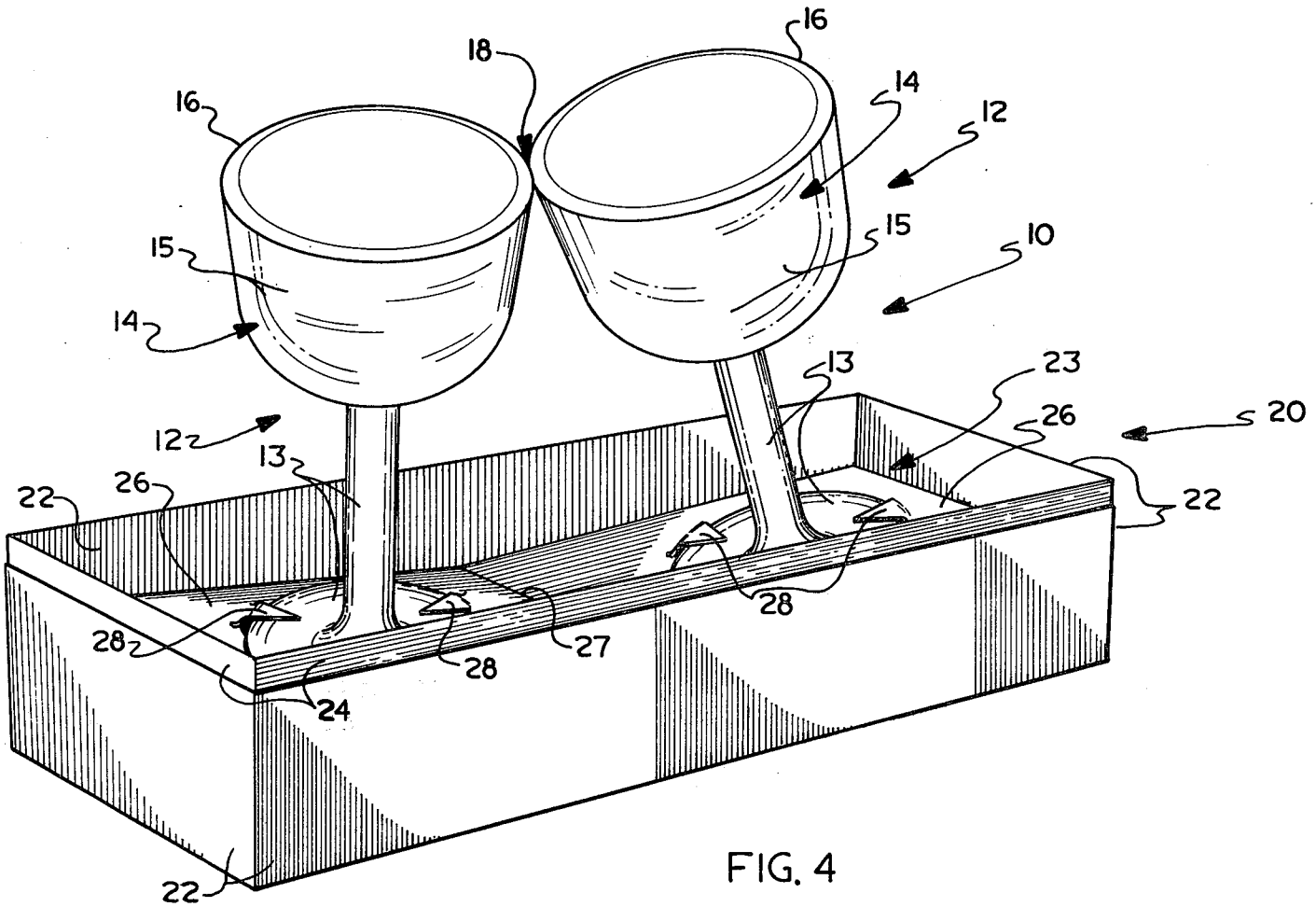
FIG. 4 is a perspective view of the resounding receptacles in the lower package member after the receptacle restraining means has been removed.

Referring to FIG. 4, receptacles 12 are within lower package 20, but receptacle restraining means 30 has been removed. Upon removal of means 30, the adjacent receptacles 12 previously restrained by restraining means 30 as seen in FIG. 2, have moved under gravitational impetus to contact one another. According to the shape of receptacle 12, this contact point 18 may occur at lip edge 16 or outer container surface 15. Further, if a container portion 14 is polyhedral in shape, the contact point 18 may occur according to the positioning of receptacles 12 on oblique base surfaces 26 as restrained by receptacle positioning means 28. The contact point 18 is the source of the sound which omits from colliding the receptacles 12. The tone of the sound of the engagement of adjacent receptacles is determined by the type of material used to form receptacles 12, as described above. The volume of the sound of the engagement of adjacent resounding receptacles is determined by the distance of restraint as controlled by spacing surfaces 34 and the tension of acute angle 35.

Referring now to FIG. 3, an understanding of the packaging concepts of upper package member 40 may be seen and understood. Like lower package member 20, upper package member 40 may be composed of any number of outer sidewall perimeter surfaces 42 according to the requirements of storing receptacles 12 in any number. In the preferred embodiment, upper package member 40 is composed of four outer sidewall perimeter surfaces jointed contiguously. Contacting the upper edge of each surface 42 is a top surface 44. The remaining possible area for a surface of upper package member 40 remains exposed to enclose and envelope receptacles 12 and contact lower package member 20. This aperture 43 is defined by the lower edges of the outer sidewall surfaces 42.

At a point within the outer sidewall surfaces 42 sufficient in height to contact outer container surfaces 15 and receptacles 12, is a securement member 46. Securement member 46 has a securement aperture 47 centrally located therewithin of a sufficient size to envelope the combination of outer container surfaces 15 of the plurality of receptacles 12. The securement aperture 47 may be so defined to fit the form and shape of a combination of surfaces 15 to provide a snug securement of the receptacles within package 10.

The replacement of securement member 46 within upper package member 40 defines a base portion storage area 45 in that area of upper package member 40 beneath securement member 46. In this base portion storage area 45 reside the entire base portions 13 and some of the container portions 14 of receptacles 12. Above securement member 46 is a container storage portion area 48, in which a segment of each container portion 14, including lip edge 16 of each receptacle 12, resides.

As with upper exposed surfaces 32 of receptacle restraining means 30, any surface 42 of upper package 40 may have information printed thereon in order to designate the occasion of celebration or award.

According to the patent statutes, a best mode and preferred embodiment of the invention has been provided, it is to be understood that the invention is not limited thereto or thereby. Consequently, for an understanding of the scope of the invention, reference is had to the following claims.

What is claimed is:

1. A package restraining a plurality of resounding receptacles, comprising:

a plurality of sidewall perimeter surfaces jointed contiguously, defining a packing recess;

a plurality of base surfaces residing in said packing recess and communicating with at least one sidewall perimeter surface;

each said base surface oblique to each said communicated sidewall perimeter surface, and each said base surface oblique to at least one adjacent said oblique surface and converging on at least one oblique surfaces intersection;

means extending from each said oblique base surface for positioning one resounding receptacle on each said oblique base surface; and means interspaced between at least two resounding receptacles for restraining contact of adjacent receptacles under gravitational impetus.

2. A package restraining a plurality of resounding receptacles, according to claim 1, wherein said plurality of sidewall perimeter surfaces is four.

3. A package restraining a plurality of resounding receptacles, according to claim 1, wherein said plurality of oblique base surfaces is two.

4. A package restraining a plurality of resounding receptacles, according to claim 3, wherein at least one said oblique surfaces intersection is one.

5. A package restraining a plurality of resounding receptacles, according to claim 1, wherein said restraining means comprises a material having two exposed surfaces above said resounding receptacles, two spacing surfaces between adjacent resounding receptacles, and an acute angle fold between said spacing surfaces.

6. A package restraining a plurality of resounding receptacles, according to claim 1, further comprising:

a plurality of acute sidewall surfaces and a top surface defining a storage area;

a securement member communicating with at least two of said outer sidewall surfaces within said storage area, said securement member, said sidewall surfaces, and said top surface defining a container portion storage area; and said securement member having an aperture therewithin in communication with the container portions of the resounding receptacles.

7. A package restraining a plurality of resounding receptacles, according to claim 6, wherein said plurality of outer sidewall surfaces is four.

8. A package restraining a plurality of resounding receptacles, according to claim 6, wherein each said sidewall perimeter surface has a recessed shoulder for communication with each said outer sidewall surface during storage.

9. A package restraining a plurality of resounding receptacles, according to claim 1, wherein said oblique communication of each said base surface with each said sidewall perimeter surface at an angle of inclination from about 0 degrees to about 40 degrees.

10. A package restraining a plurality of resounding receptacles, according to claim 1, wherein said oblique communication of each said base surface with each said sidewall perimeter surface at an angle of inclination from about 10 degrees to 20 degrees.

* * * * *